US007829780B2

(12) United States Patent
Onozawa

(10) Patent No.: US 7,829,780 B2
(45) Date of Patent: Nov. 9, 2010

(54) HYBRID WIND MUSICAL INSTRUMENT AND ELECTRIC SYSTEM INCORPORATED THEREIN

(75) Inventor: Naoyuki Onozawa, Shizuoka-Ken (JP)

(73) Assignee: Yamaha Corporation, Shizuoka-ken (JP)

( * ) Notice: Subject to any disclaimer, the term of this patent is extended or adjusted under 35 U.S.C. 154(b) by 31 days.

(21) Appl. No.: 12/134,548

(22) Filed: Jun. 6, 2008

(65) Prior Publication Data

US 2009/0020000 A1 Jan. 22, 2009

(30) Foreign Application Priority Data

Jul. 17, 2007 (JP) ..... 2007-185563

(51) Int. Cl.
*G10D 7/08* (2006.01)

(52) U.S. Cl. ..... 84/732; 84/644; 84/743; 84/385 R; 84/729; 600/729

(58) Field of Classification Search ..... 84/644, 84/670, 718, 723, 732, 743, 385 R, 600, 729
See application file for complete search history.

(56) References Cited

U.S. PATENT DOCUMENTS

| | | | | | |
|---|---|---|---|---|---|
| D145,890 | S | * | 11/1946 | Gillespie | D17/13 |
| 2,425,795 | A | * | 8/1947 | Gillespie | 84/385 R |
| 2,474,836 | A | * | 7/1949 | Gillespie | 84/385 R |
| 2,494,783 | A | * | 1/1950 | Swihart | 84/385 R |
| 2,570,354 | A | * | 10/1951 | Loney | 84/385 R |
| 2,971,423 | A | * | 2/1961 | LeBlanc | 84/380 R |
| 3,507,971 | A | * | 4/1970 | Feddersen | 84/723 |
| 3,657,464 | A | * | 4/1972 | Pascucci | 84/380 R |
| 3,938,419 | A | * | 2/1976 | De Rosa | 84/678 |
| 4,342,244 | A | * | 8/1982 | Perkins | 84/672 |
| 4,527,456 | A | * | 7/1985 | Perkins et al. | 84/654 |
| 5,149,904 | A | * | 9/1992 | Kamiya et al. | 84/723 |
| 5,354,947 | A | * | 10/1994 | Kunimoto et al. | 84/622 |
| 5,668,340 | A | * | 9/1997 | Hashizume et al. | 84/742 |
| 5,736,662 | A | * | 4/1998 | Spector | 84/600 |
| 6,002,080 | A | * | 12/1999 | Tanaka | 84/615 |
| 6,329,582 | B1 | * | 12/2001 | Catalano, Jr. | 84/385 R |

(Continued)

FOREIGN PATENT DOCUMENTS

DE 4435471 A1 4/1996

(Continued)

OTHER PUBLICATIONS

Synthophone: Spec Page, the Synthophone: Technical Specs, Softwind Instruments: "The Synthophone Zone", Internet Citation XP002393502, Retrieved from the Internet: URL:http://web.archive.org/web/200104040347-14/home.alt.net/{synthophone/> [retrieved Aug. 4, 2006], pp. 1, 6, 12.

*Primary Examiner*—David S. Warren
(74) *Attorney, Agent, or Firm*—Dickstein Shapiro LLP

(57) ABSTRACT

A hybrid wind musical instrument is a combination between an alto saxophone and an electronic system so that a player can perform a music tune selectively through acoustic tones and electronic tones; although various parts and accessories are assembled into the alto saxophone, a bell brace makes it possible to sustain a control unit of the electronic system without damage of alto saxophone and undesirable influence on acoustic characteristics of the tubular instrument body.

20 Claims, 9 Drawing Sheets

U.S. PATENT DOCUMENTS

| | | | | |
|---|---|---|---|---|
| 6,525,252 | B1 * | 2/2003 | Klausen et al. | 84/600 |
| 6,538,189 | B1 * | 3/2003 | Ethington | 84/615 |
| 6,881,890 | B2 * | 4/2005 | Sakurada | 84/654 |
| 7,049,503 | B2 * | 5/2006 | Onozawa et al. | 84/723 |
| 7,390,959 | B2 * | 6/2008 | Masuda | 84/723 |
| 7,470,852 | B2 * | 12/2008 | Masuda | 84/615 |
| 2005/0217464 | A1 * | 10/2005 | Onozawa et al. | 84/723 |
| 2006/0283312 | A1 * | 12/2006 | Shibata | 84/724 |
| 2007/0017346 | A1 | 1/2007 | Masuda | |
| 2008/0087157 | A1 | 4/2008 | Suzuki et al. | |
| 2008/0314226 | A1 | 12/2008 | Shibata | |
| 2009/0019999 | A1 | 1/2009 | Onozawa | |
| 2009/0020000 | A1 | 1/2009 | Onozawa | |

FOREIGN PATENT DOCUMENTS

| | | | |
|---|---|---|---|
| EP | 1 585 107 | A2 | 10/2005 |
| GB | 1393542 | A | 2/1972 |
| JP | 63-47397 | | 3/1988 |
| JP | 633514 | | 8/1994 |
| JP | 2005-316417 | | 11/2005 |

* cited by examiner

HYBRID WIND MUSICAL INSTRUMENT AND ELECTRIC SYSTEM INCORPORATED THEREIN

FIELD OF THE INVENTION

This invention relates to a wind musical instrument and, more particularly, to a hybrid wind musical instrument callable of selectively producing electronic tones and acoustic tones and an electric system incorporated therein.

DESCRIPTION OF THE RELATED ART

A typical example of the hybrid wind musical instrument is disclosed in Japan Patent Application laid-open No. 2005-316417. The prior art hybrid wind musical instrument has an external appearance like a standard saxophone, and includes the tube body, key mechanism, key sensor system, acoustic mouthpiece, electronic mouthpiece, controller and sound system. The lip sensor, wind sensor and tonguing sensor are provided inside the electronic mouthpiece.

When a user wishes to perform a music tune through the acoustic tones, the acoustic mouthpiece is fitted to the tube body. While the user is blowing into the acoustic mouthpiece, the column of air vibrates for producing the acoustic tones, and the user fingers on the key mechanism for changing the pitch of acoustic tones.

On the other hand, the electronic mouthpiece, key sensor system, controller and sound system are prepared for performance through electronic tones. When a user wishes to perform a music tune through the electronic tones, the acoustic mouthpiece is replaced with the electronic mouthpiece. While the user is blowing into the electronic mouthpiece, the sensors produce the electric signal representative of how the player varies the breath, lips and tongue, and key sensor system produces the electric signals representative of current key position. The electric signals are supplied to the tone generating system, and the tone generating system and sound system produce the electronic tones on the basis of the pieces of performance data carried on the electric signals.

Although the controller is illustrated in the drawings, the Japan Patent Application laid-open is silent to how the controller is supported by the tube body. In fact, the key mechanism is provided on the outer surface of the tube body, and is implemented by a complicated linkwork, i.e., a combination of keys, key rods, key posts and so forth. Since the component parts of linkwork are integrated at high density on the outer surface of tube body, it is not easy to attach the controller to the outer surface of tube body without any impediment to the function of linkwork.

SUMMARY OF THE INVENTION

It is therefore an important object of the present invention to provide a hybrid wind musical instrument, a controller of which is attached to an instrument body without any undesirable influence of the other component parts.

It is also an important object of the present invention to provide an electric system, which is incorporated in the hybrid wind musical instrument.

The present inventor contemplated the requirement, and determined the following conditions to be fulfilled by a certain portion to which a controller is fitted.

1. The controller fitted to the certain portion does not impede players in fingering on the key mechanism.

2. The certain portion is rigid enough to support the controller without serious influences on acoustic characteristics of an acoustic wind instrument.
3. The certain portion permits a player to put the wind instrument already equipped with the controller on a table in stable.

The present inventor investigated various portions of the instrument body and attachments of the wind musical instrument to see whether or not they fulfilled the above-described conditions, and found a bell brace to be most appropriate.

To accomplish the object, the present invention proposes to fit a controller to a bell brace of an acoustic wind instrument.

In accordance with one aspect of the present invention, there is provided a hybrid musical instrument for selectively producing acoustic tones and electric tones, and the hybrid musical instrument comprises a tubular instrument body defining a vibratory column of air therein and having a bell through which vibrations of the vibratory column of air are propagated to the outside of the tubular instrument body as acoustic tones while a player is giving rise to the vibrations, a wind inlet piece connected to the tubular instrument body and blown by the player, an array of manipulators provided on the tubular instrument body and selectively manipulated by the player for specifying an attribute of both of the acoustic tones and electric tones, a bell brace connected between the bell and another portion of the tubular instrument body and an electric system including sensors monitoring movements of the manipulators and the blow into the wind inlet piece for producing pieces of performance data and a control unit sustained by the tubular instrument body through the bell brace and connected to the sensors for producing an electric signal representative of the attribute and other attributes of the electric tones.

In accordance with another aspect of the present invention, there is provided an electric system for retrofitting an acoustic wind instrument including a tubular instrument body having a bell reinforced with a bell brace, a wind inlet piece and an array of manipulators to a hybrid musical instrument, and the electric system comprises sensors monitoring movements of the manipulators and blow into the wind inlet piece for producing pieces of performance data and a control unit sustained by the tubular instrument body through the bell brace and connected to the sensors for producing an electric signal representative of an attribute of electric tones specified through the manipulators and other attributes of the electric tones.

BRIEF DESCRIPTION OF THE DRAWINGS

The features and advantages of the hybrid wind musical instrument and electric system will be more clearly understood from the following description taken in conjunction with the accompanying drawings, in which.

DESCRIPTION OF THE PREFERRED EMBODIMENTS

Figure 1:
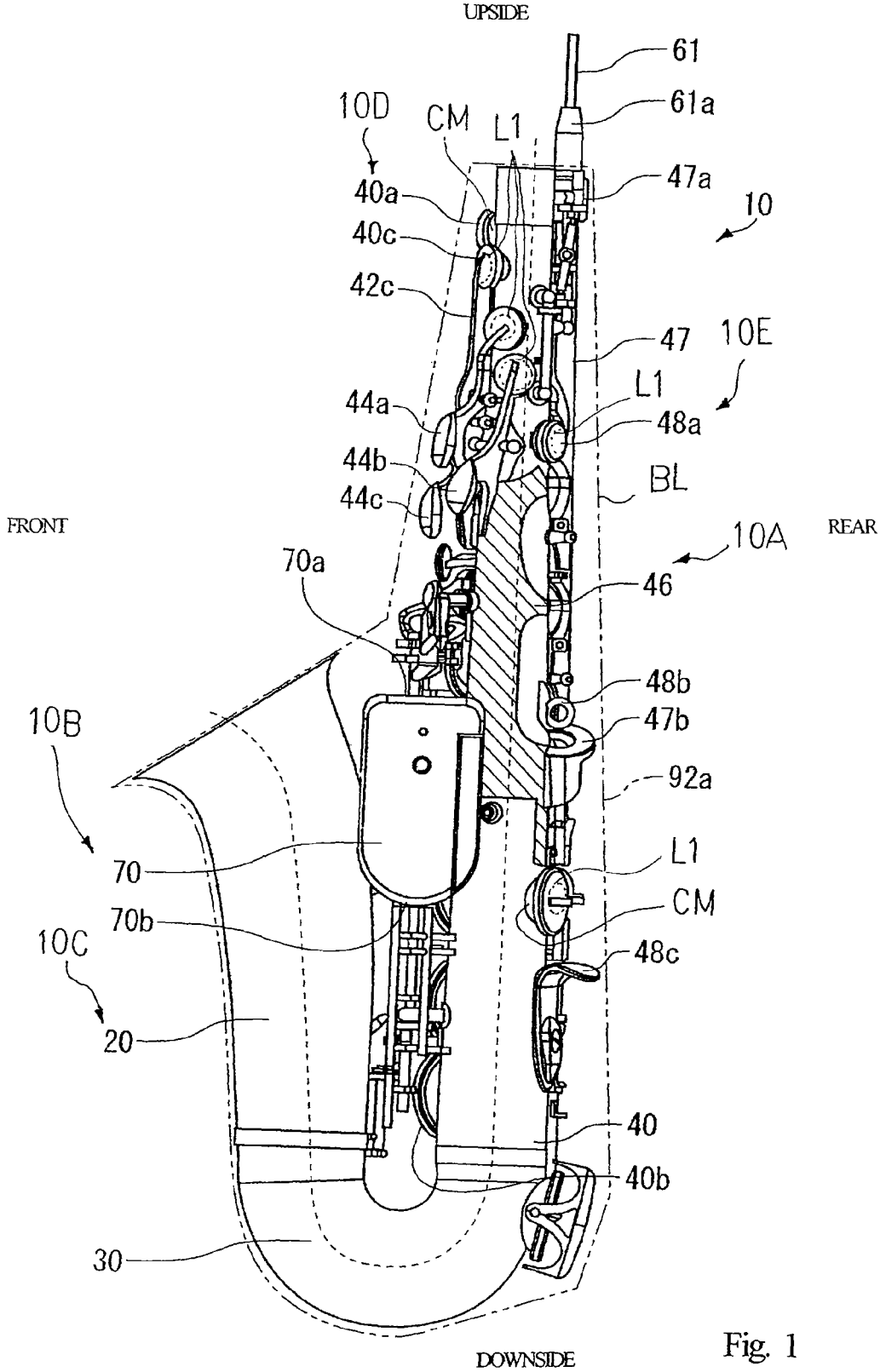
FIG. 1 is a left side view showing the structure of an alto saxophone forming a part of a hybrid musical instrument of the present invention.

A hybrid musical instrument is used for performance of music tunes selectively through acoustic tones and electric tones. The hybrid musical instrument comprises a tubular instrument body, a wind inlet piece, an array of manipulators, a bell brace and an electric system. The tubular instrument body, wind inlet piece, array of manipulators and bell brace may form an acoustic wind instrument. In this instance, the manufacturer has assembled the acoustic wind instrument with the electric system before delivery to users. Otherwise, only the electric system is delivered to users, and the users assemble the electric system with their own acoustic wind instrument.

The tubular instrument body defines a vibratory column of air therein, and has a bell. While a player is giving rise to vibrations of the column of air, the vibrations of the vibratory column of air are propagated through the bell to the outside of the tubular instrument body, and the vibrations are recognized as acoustic tones.

The wind inlet piece is connected to the tubular instrument body, and the player gives blows to the wind inlet piece so as to give rise to the vibrations of column of air. The array of manipulators is provided on the tubular instrument body, and the manipulators are selectively manipulated by the player for specifying an attribute of the acoustic tones. While the player is performing a music tune through the electric tones, the blow may not give rise to the vibrations of column of air. The bell brace is connected between the bell and another portion of the tubular instrument body, and enhances the rigidity of the tubular instrument body.

The electric system includes sensors and a control unit. The sensors monitor movements of the manipulators and the blow into the wind inlet piece. Electric signals are output from the sensors, and are representative of pieces of performance data. The pieces of performance data express the attribute of electric tones and other attributes of electric tones. In this instance, the attribute of tone is the pitch of electric tones, and the loudness and time period over which the electric tones is continued are examples of the other attributes. However, the attributes to be determined are dependent on how the electric tones are produced.

The control unit is sustained by the tubular instrument body through the bell brace. The bell brace is rigid so that the control unit is stable over the tubular instrument body. Moreover, the bell brace keeps the control unit spaced from the surface of tubular instrument body. For this reason, the control unit does not have any undesirable influence on the acoustic tones.

The control unit is connected to the sensors so that the electric signals are processed in the control unit. The control unit produces an electric signal representative of the attribute and other attributes of the electric tones. The electric tones are produced on the basis of the electric signal.

As will be understood from the foregoing description, the control unit is sustained in stable by the tubular instrument body through the bell brace without any undesirable influence of acoustic tones.

In the following description, terms "upside", "downside", "right" and "left" are determined by a player who is blowing the hybrid musical instrument. While the player is playing a music tune on the hybrid musical instrument, a "rear" portion of hybrid musical instrument is closer to the player than a "front" portion of the hybrid musical instrument.

First Embodiment

Structure of Alto Saxophone

Referring to FIGS. 1 to 4 of the drawings, a hybrid wind musical instrument 10 embodying the present invention largely comprises an acoustic wind instrument 10A and an electronic system 10B. A player blows the acoustic wind instrument 10A, and produces acoustic tones through vibrations of air column defined in the acoustic wind instrument 10A. The electronic system 10B is combined with the acoustic wind instrument 10A. While a player is playing a music tune on the acoustic wind instrument 10A combined with the electronic system 10B, electronic tones are produced through the electronic system 10B without any acoustic tones. Thus, the player can play music tunes on the hybrid wind musical instrument 10 selectively through the acoustic tones and electronic tones. In this instance, an alto saxophone is used as the acoustic wind instrument 10A.

While a player is performing a music tune on the hybrid wind musical instrument, he or she holds the hybrid wind musical instrument in his or her hands. Essential parts of the electronic system 10B are fitted to the acoustic wind instrument 10A so that the player can freely twist and incline his or her body during the performance. The acoustic wind instrument 10A has a rigid reinforcing component part, and a heavy system component of the electronic system 10B is fitted to the rigid reinforcing component part. For this reason, there is not possibility to damage the acoustic wind instrument 10A.

Figure 5:
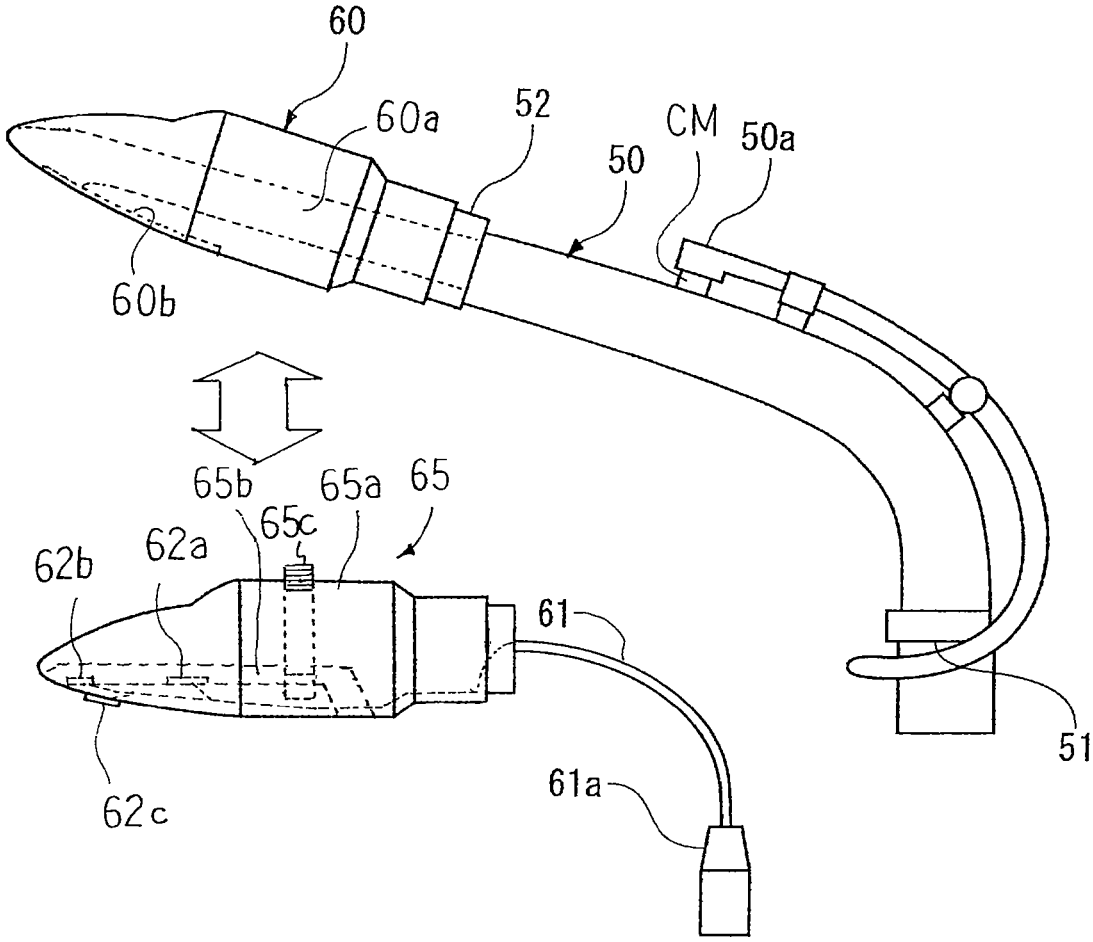
FIG. 5 is a right side view showing an acoustic mouthpiece and an electronic mouthpiece both forming parts of the hybrid musical instrument.

The acoustic wind instrument 10A includes a tubular instrument body 10C, a key mechanism 10D, accessory pats 10E and an acoustic mouthpiece 60, which is shown in FIG. 5. The acoustic mouthpiece 60 is fitted to one end of the tubular instrument body 10C, and is held in player's mouth for blowing. The key mechanism 10D is fitted onto the outer surface of the tubular instrument body 10C. The vibratory column of air is defined in the tubular instrument body 10C, and a player varies the length of vibratory column of air by means of the key mechanism 10D, thereby changing the pitch of acoustic tones.

The tubular instrument body 10C is broken down into a bell 20, a bow 30, a body 40 and a neck 50, and the bell 20, bow 30, body 40 and neck 50 are made of alloy. The body 40 is corresponding to the second tube of a standard alto saxophone. The bow 30 is curved so as to have a configuration like U-letter. The bell 20 is connected to one end of the bow 30, and is upwardly flared. The body 40 is connected at one end thereof to the other end of the bow 30 and at the other end thereof to a connecting portion 51 of the neck 50. Thus, the tubular instrument body 10C has a generally J-letter shaped configuration. The acoustic mouthpiece 60 is fitted to the other end portion of the neck 50.

Plural tone holes are formed in the bell 20, bow 30, body 40 and neck 50, and tone hole chimneys project from the peripheries defining the tone holes. Broken lines L1 are indicative of the locations of tone holes in FIG. 1, and several tone hole chimneys are labeled with reference "CM". The broken lines L1 and reference sign CM are removed from the other figures so as to make the illustration less complicated. The tone holes are selectively opened and closed with the key mechanism 10D, and a player varies the length of vibratory column of air by means of the key mechanism 10D.

The key mechanism 10D is similar to the key mechanism of a standard alto saxophone so that a player fingers on the key mechanism 10D in a similar manner to the fingering on the alto saxophone. The key mechanism 10D includes keys for the left hand such as, for example, a high F key 40*c* and a table key 40*x*, keys for the right hand keys such as, for example, a D key 40*b*, touch-pieces 43*a* to 43*e* for the left hand keys, levers 44*a* to 44*e* for the left hand keys, touch-pieces 43*f* to 43*h* for the right hand keys and levers 44*f* to 44*l* for the right hand keys. The touch-pieces 43*a* to 43*h* and levers 44*a* to 44*l* are assigned to the thumbs and fingers in the standard fingering rules of alto saxophone. The high F# key 40*a* to D key 40*b* and table key 40*x* are provided on the body 40, and the low C key 30*a* and low C# key 30*b* are provided on the bow 30. The low B key 20*a* and low Bb key 20*b* are provided on the bell 20.

A player selectively opens and closes the keys for the heft hand by mans of the touch-pieces 43*a* to 43*e*, levers 44*a* to 44*e* and 44*l*, and selectively opens and closes the keys for the right hand by means of the touch-pieces 43*f* to 43*h* and levers 44*f* to 44*l*. For example, the lever 44*i* is depressed and released for the high F# key 40*a*, and the high F key 40*c* is driven to open and close the tone hole by means of the lever 44*c*. Similarly, the touch-piece 43*h* is directly connected to the D key 40*b* so that a player depresses and releases the touch-piece 43*h* so as to open and close the tone hole with the D key 40*b*. The table key 40*x* is directly depressed and released with the little finger of left hand, and is located at the lowest position in the region assigned to the left hand.

The key mechanism 10D further includes arms such as, for example, 22*b*, 32*a*, 42*a*, 42*c*, 45*c* and 45*d* and key rods such as, for example, 21*b*, 31*a*, 41*c* and 41*a*. The arms and rods are provided between the levers 44*a* to 44*l* and the keys, and torque, which are exerted on the levers 44*a* to 44*l*, are transmitted through the arms and key rods to the associated keys.

Thus, even though the keys are remote from the levers 44*a* to 44*l*, a player can open and close the tone holes with the keys by virtue of the arms and rods. For example, the arm 42*a* is connected to the high F# key 40*a*, and the key rod 41*a* is connected between the arm 42*a* and the lever 44*i*. When a player exerts torque on the lever 44*i*, the torque is transmitted through the key rod 41*a* and arm 42*a* to the high F# key 40*a*, and the high F# is driven for rotation. Thus, the tone hole is opened and closed with the high F# key 40*a* by mean of the lever 44*i*. Similarly, the arm 42*c* is connected to the high F key 40, and the key rod 41*c* is connected between the arm 42*c* and the lever 44*c*. When a player depresses the lever 44*c*, the torque is transmitted from the lever 44*c* through the key rod 41*c* and arm 42*c* to the high F key 40*a*, and the high F key 40*a* is driven for rotation. Thus, the tone hole is opened and closed with the high F key 40*a* by means of the lever 44*c*.

The low C key 30*a* is connected to the arm 32*a*, which in turn is connected to the key rod 31*a*. The low Bb key 20*b* is connected to the arm 22*b*, which in turn is connected to the key rod 21*b*. Torque is transmitted from the other levers to the associated keys through the arms and key rods. However, the arrangement of key mechanism 10D is similar to that of a standard alto saxophone. For this reason, no further description is hereinafter for the sake of simplicity.

As shown in FIG. 5, the acoustic mouthpiece 60 is formed with an air passage 60*a*, and is fitted to the neck 50 in such a manner that the air passage 60*a* is connected to the air passage in the tubular instrument body 10C. The acoustic mouthpiece 60 includes a reed 60*b*, and the reed 60*b* is exposed to the air passage 60*a*. While a player is performing a music tune on the hybrid wind instrument 10 through the acoustic tones, he or she puts the acoustic mouthpiece 60 in his or her mouth, and blows into the air passage 60*a*. Then, the reed 60*b* vibrates, and the vibrations of reed 60*b* are propagated to the column of air. Thus, the player gives rise to the vibrations of air column with the reed 60*b* attached to the acoustic mouthpiece 60.

A thumb rest 48*a*, a strap hook 48*b*, a finger hook 48*c*, a mouthpiece cork 52, a bell brace 80, a ligature (not shown), key guards 23 and 33*a* (see FIGS. 2, 3 and 4) and a cable guard 47 are categorized in the accessory parts 10E. As described hereinbefore, the player depresses and releases the touch-pieces 43*a* to 43*h* and levers 44*a* to 44*l* with his or her thumbs and fingers in performance. However, the player does not always exert force on the touch-pieces and levers with all of the thumbs and fingers. In order to make the idling thumbs take a rest, the thumb rest 48*a* is provided at the back of the levers 44*a* to 44*c* for the thumb of left hand. On the other hand, the finger hook 48*c* is prepared for the thumb of right hand at the back of the touch-pieces 43*f* and 43*g*.

The strap hook 48*b* is formed in the rear potion of the body 40. While a player is playing a music tune on the hybrid wind musical instrument 10, the player puts on a strap (not shown), and hooks up the strap hook 48*b* on the strap. Thus, the hybrid wind musical instrument 10 is hung from player's neck through the strap.

The mouthpiece cork 52 makes the acoustic mouthpiece 60 hermetically connected to the neck 50. The reed 60*b* is fitted to the acoustic mouthpiece 60 by means of the ligature (not shown).

The bell brace 80 is a rigid component part, and is capable of sustaining surely heavy parts without breakage thereof. In fact, the bell brace 80 is less liable to be damaged rather than surface portions of tubular instrument body 10C. Although the tubular instrument body 10C is curved from the body 40 to the bell 20, the body 40 has a certain portion, the center axis of which is roughly in parallel to a corresponding portion of the bell 20. The bell brace 80 is connected at one end thereof to the certain portion of body 40 and at the other end thereof to the corresponding portion of bell 20, and reinforces the tubular instrument body 10C. Moreover, the bell brace 80 is adapted to regulate acoustic characteristics of tubular instrument body 10C such as reverberation and long sound range. Since the bell brace 80 extends in the space between the body 40 and the bell 20, the thumbs and fingers of player do not invade the space around the bell brace 80.

Since the key mechanism 10D are exposed to the environment, players feel the key mechanism 10D to be liable to be unintentionally damaged. Moreover, when the players put their hybrid wind instruments 10 on tables, the keys, touch-pieces and levers make the hybrid wind instruments unstable on the tables. In order to sustain the hybrid wind instrument 10 on the table in stable, the key guard 23 and 33*a* are provided as the accessory parts 10E. The key guards 23 and 33*a* are attached to the bell 20. The key guard 23 is provided in association with the low Bb key 20*b* and low B key 20*a*, prevents these keys 20*a* and 20*b* from undesirable damage. The key guard 33*a* is provided in association with the low C key 30*a*, and prevents the key 30*a* from damage.

When a player puts the hybrid wind instrument 10 on a table TL (see FIG. 3), he or she brings the key guards 23 and 33*a* into contact with the table TL, and the key guards 23 and 33*a* make the hybrid wind instrument 10 stable on the table without damage. In this situation, the key guards 23 and 33*a* keep the bell brace 80 and, accordingly, control unit 70 over the table TL.

As will be described hereinlater in detail, a control unit 70 of the electronic system 10B is secured to the bell brace 80, and occupies the space around the bell brace 80. For this reason, the control unit 70 does impede the fingering of player on the touch-pieces 43*a* to 43*h* and levers 44*a* to 44*l*, and the player can put the hybrid wind instrument 10, the keys of which are guarded with the key guard, on the table without separation of the control unit 70 from the bell brace 80.

In detail, the control unit 70 occupies part of the space between the table key 40*x* depressed with the little finger of left hand and the finger hook 48*c* for the thumb of right hand. While a player is performing a music tune on the acoustic wind instrument 10, the player keeps the left hand over the right hand. The touch-pieces 43*a* to 43*e* and levers 44*a* to 44*e* for the left hand keys are spaced from the touch-pieces 43*f* to 43*h* and levers 44*f* to 44*l* for the right hand keys in a direction parallel to the longitudinal direction of the tubular instrument body 10C, i.e., the up-and-down direction, and the thumb rest 48*a* for the left hand and finger hook 48*c* for the right hand are prepared in the space beside the touch-pieces 43*a* to 43*e* and levers 44*a* to 44*e* for the left hand and the space beside the touch-pieces 43*f* to 43*h* and levers 44*f* to 44*l* for the right hand, respectively. In this arrangement, the lever 44*e* for the little finger of left hand is the lowest of the touch-pieces 43*a* to 43*e* and levers 44*a* to 44*e* for the left hand keys, and the touch-pieces 43*f* to 43*h* and levers 44*f* to 44*l* for the right hand keys are provided over the surface of tubular instrument body 10C on the opposite side to the bell brace 80. The finger hook 48*c* is provided on the same side as the bell brace 80. In this situation, it is rare that player's fingers and thumbs invade the space between the table key 40*x* for the little finger of left hand and the finger hook 48*c* for the thumb of right hand. Thus, the space between the table key 40*x* and the finger hook 48*c* is appropriate for the control unit 70.

Figure 2:
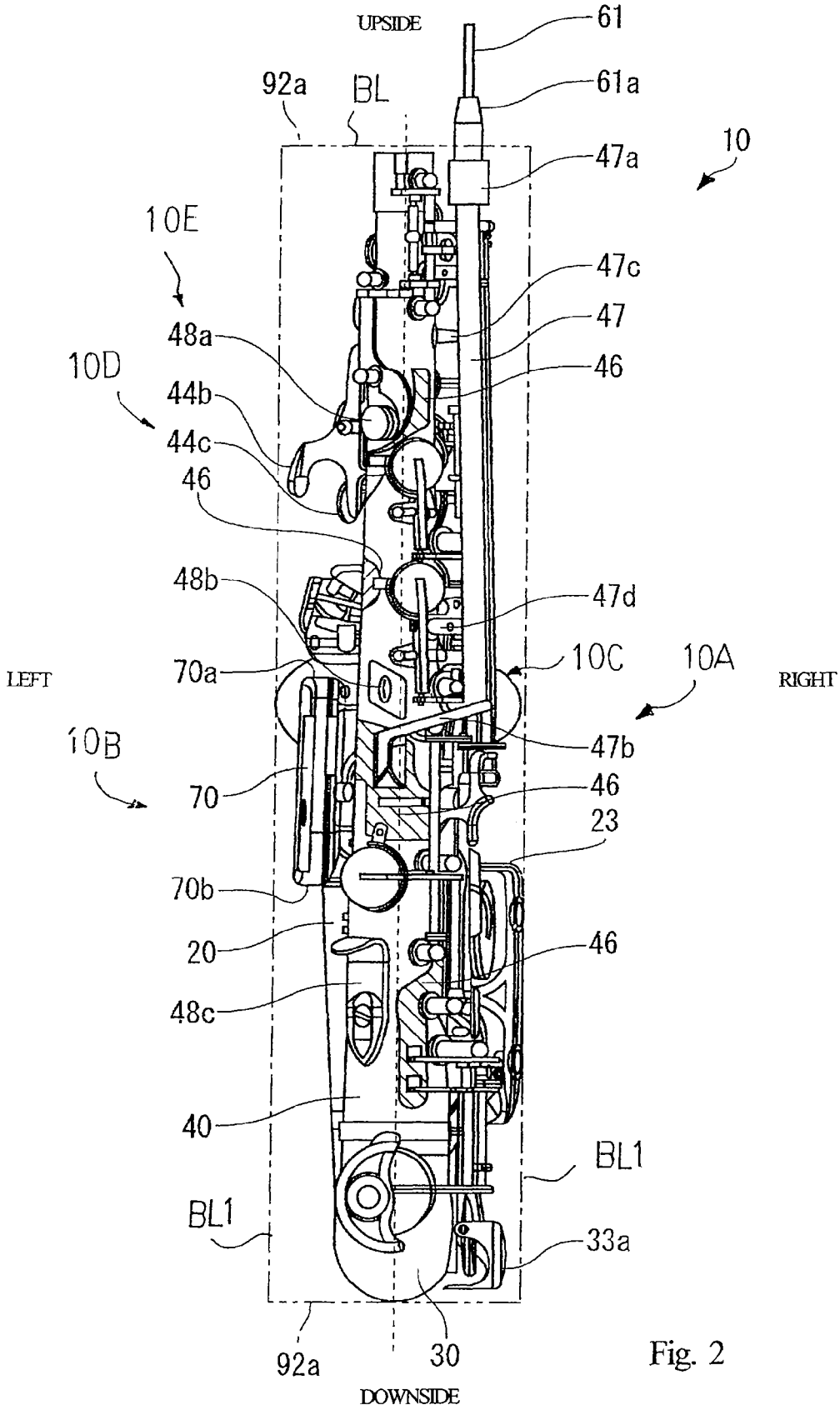
FIG. 2 is a back view showing the structure of the alto saxophone.

The cable guard 47 is tubular, and is made of light metal such as, for example, aluminum or aluminum alloy. The cable guard 47 extends from the boundary between the neck 50 and the body 40 to a vicinity of the control unit 70, and is adhered to the tubular instrument body 10C by means of couplings 47*c* and 47*d* as shown in FIG. 2. Although the component parts of key mechanism 10C are arranged at high density in the space around the upper portion of the body 40, a narrow space is found between the thumb rest 48*a* for the left hand and the key rod 41*a* and adjacent key rods, the narrow space is assigned to the cable guard 47.

The downstream cable (not shown) is housed in the cable guard 47 so that player's fingers do not get caught in the downstream cable in performance. In other words, the player does not unintentionally disconnect the downstream cable from the upstream cable 61.

The cable guard 47 has a connector 47*a* at the upper end thereof and another connector 47*b* at the lower end thereof. The connector 47*a* is connected to a downstream cable (not show), and the downstream cable passes from the connector 47*a* through an inner space of the cable guard 47 to the connector 47*b*.

System Configuration of Electronic System 10B

Figure 6:
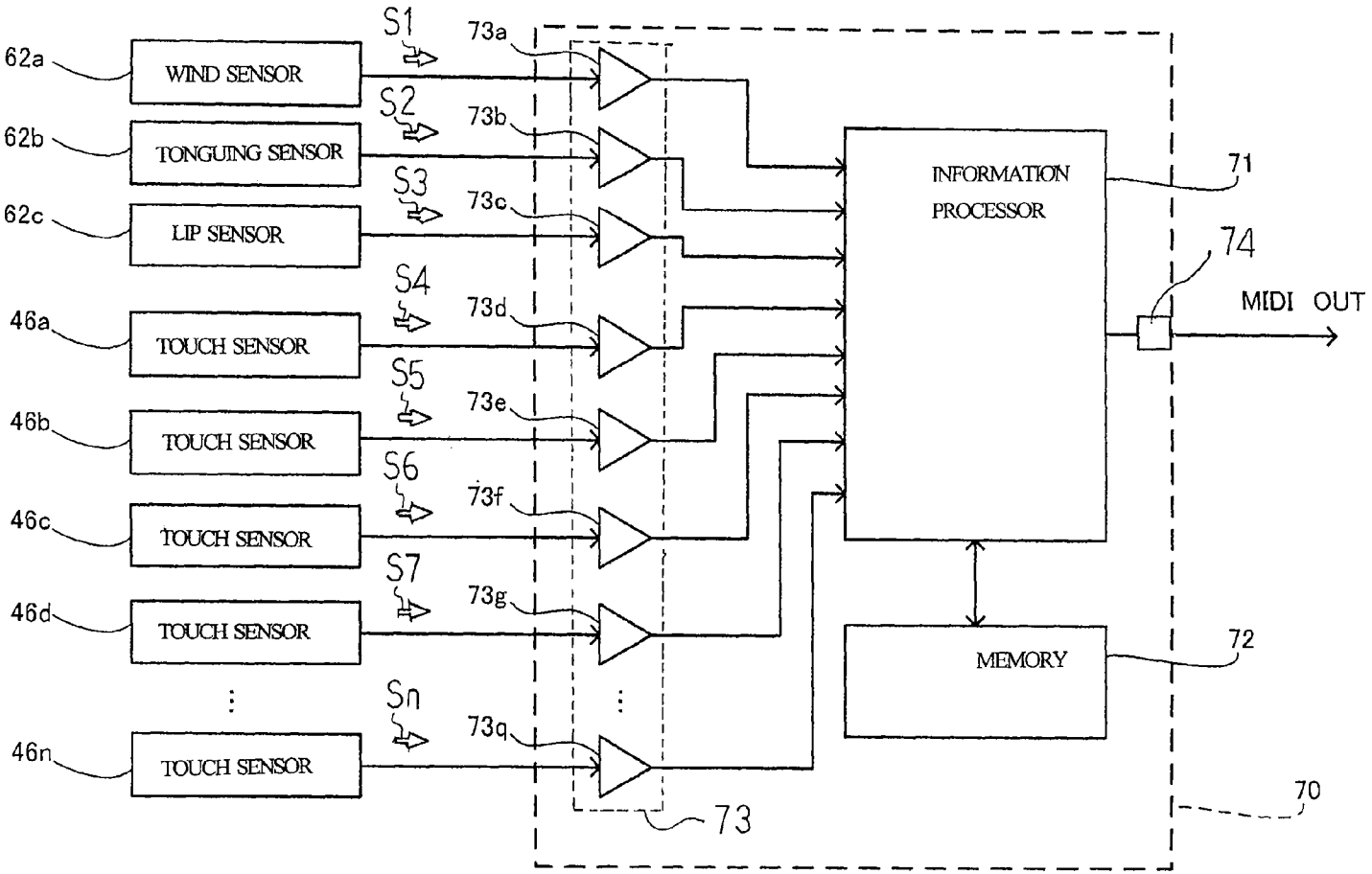
FIG. 6 is a block diagram showing the system configuration of an electronic system of the hybrid musical instrument.

The control unit 70, cables 61 and connectors 61*a*, 47*a* and 47*b* form parts of the electronic system 10B. The electronic system 10B further includes an electronic mouthpiece 65, a flexible circuit board 46 and sensors 62*a*, 62*b*, 62*c*, 46*a*, 46*b*, 46*c*, 46*d*, . . . and 46*n*. The electronic mouthpiece 65 is illustrated in FIG. 5, and sensors 62*a* to 62*c* and 46*a* to 46*n* are shown in FIG. 6.

The electronic mouthpiece 65 is replaceable with the acoustic mouthpiece 60. When a player wishes to perform a music tune through the electronic tones, he or she separates the acoustic mouthpiece 60 from the mouthpiece cork 52, and connects the electronic mouthpiece 65 to the neck 50 through the mouthpiece cork 52.

The electronic mouthpiece 65 has a mouthpiece body 65*a*, which has a configuration like the acoustic mouthpiece 60. The mouthpiece body 65*a* is formed with an air passage 65*b*, and the air passage 65*b* is open to the lower surface of the mouthpiece body 65*a*. In other words, the air passage 65*b* is not connectable to the vibratory column of air in the tubular instrument body 10C. An orifice plate 65*c* is rotatably supported by the mouthpiece body 65*a*, and crosses the air passage 65*b*. The orifice plate 65*c* is formed with a variable orifice, and the variable orifice stops down the air passage 65*b*. The area of variable orifice in the air passage 65*b* is dependent on the angular position of the orifice plate 65*c* so that a player adjusts the backpressure to a value optimum to him or her by rotating the orifice plate 65*c*.

The sensors 62*a*, 62*b* and 62*c* are called as "wind sensor", "tonguing sensor" and "lip sensor", respectively. The wind sensor 62*a* is provided in the air passage 65*b*, and converts the pressure of breath to a detecting signal S1.

The tonguing sensor 62*b* is implemented by a photo-coupler, and is provided in the vicinity of the inlet opening of air passage 65*b* so as to radiate a light beam toward the inlet opening. When the player projects his or her tongue during the performance, the tip of tongue is brought into contact with the end surface of mouthpiece body 65*a*, and makes the amount of reflection varied. Thus, the tonguing sensor 62*b* converts the projection of tongue to a detecting signal S2.

The lip sensor 62*c* is provided on the lower surface of the mouthpiece body 65*a* in the vicinity of the inlet opening of air passage 65*b*. When the player blows, he or she puts the electronic mouthpiece 65 into the mouth, and presses the electronic mouthpiece 65 with lips. The lip sensor 62*c* converts the pressure exerted by the lips to a detecting signal S3. Thus, the detecting signals S1 to S3 are representative of pieces of performance data expressing the breath pressure, position of tongue and state of lips.

The detecting signals S1, S2, S3 are propagated from the wind sensor 62*a*, tonguing sensor 62*b* and lip sensor 62*c* through an upstream cable 61. The upstream cable 61 is terminated at a connector 61*a*, and the connector 61*a* is engaged with and disengaged from the connector 47*a*. When a player engages the connector 61*a* with the connector 47*a*, the wind sensor 62*a*, tonguing sensor 62*b* and lip sensor 62*c* are electrically connected through the upstream cable 61, connectors 61*a* and 47*a* and downstream cable (not shown) to the connector 47*b*. When the player separates the electronic mouthpiece 65 from the tubular instrument body 10C, he or she disconnects the upstream cable 61 from the downstream cable by disengaging the connector 61*a* from the connector 47*a*. Thus, the player can easily replace the electronic mouthpiece 65 to the acoustic mouthpiece 60 and vice versa.

The sensors 46*a* to 46*n* are called as "touch sensors", and are respectively provided for movable parts 10Da of the key mechanism 10D such as the touch-pieces 43*a* to 43*h*, keys, arms and levers 44*a* to 44*l*. Since the touch sensors 46*a* to 46*n* are expected to detect the touch-pieces 43*a* to 43*a* and levers 44*a* to 44*l* depressed and released by a player. Some of the touch sensors 46*a* to 46*n* may be connected to the arms and key rods driven by certain touch-pieces 43*a* to 43*h* and/or certain levers 44*a* to 44*l*.

Figure 7:
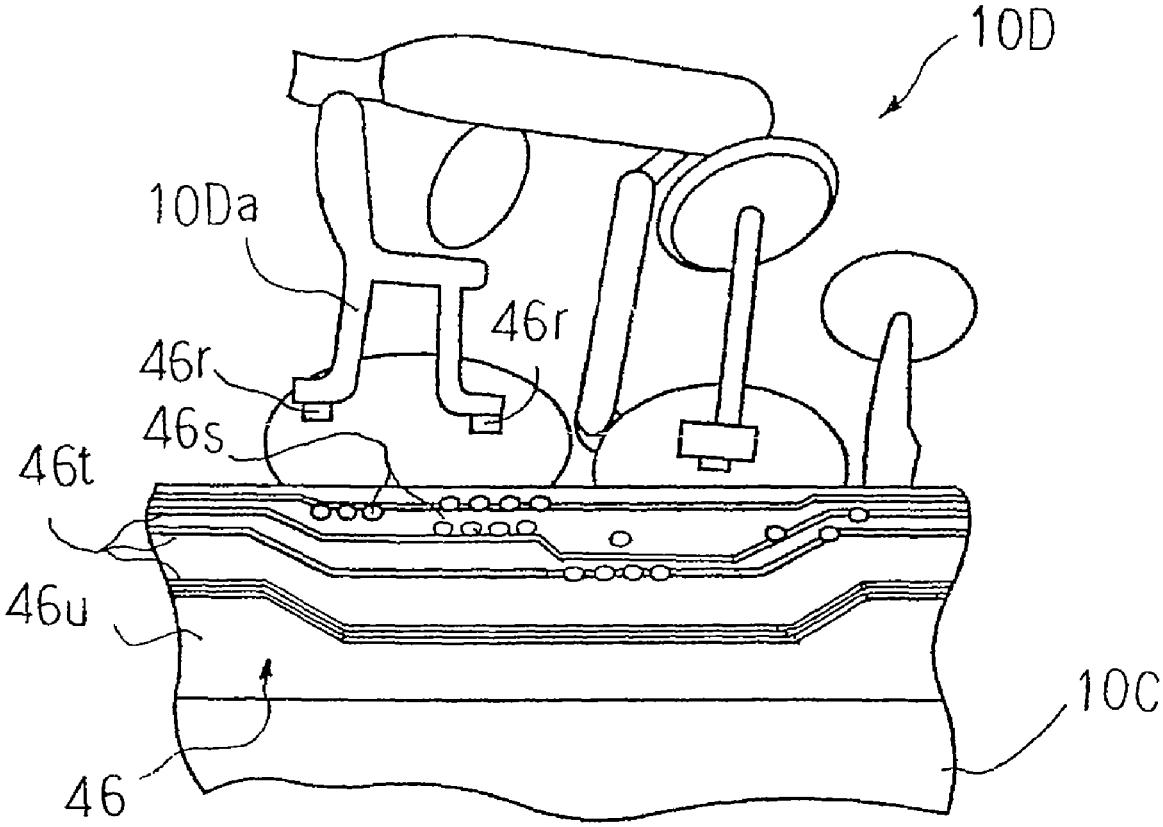
FIG. 7 is a schematic view showing touch sensors provided for keys of the hybrid musical instrument.

Each of the touch sensors 46*a* to 46*n* is implemented by a piece of magnet 46*r* and a Hall-effect element 46*s*. As shown in FIG. 7, the flexible circuit board 46 is wound on the body 40 of tubular instrument body 10C, and is secured to the tubular instrument body 10C below the key mechanism 10D. Hatching lines indicates the flexible circuit board 46 in FIGS. 1 and 2 so as to make it possible to discriminate the flexible circuit board 46 from the component parts of the acoustic wind instrument 10A. Although the several keys such as, for example, the low C key 30*a* low Bb key 20*b* are provided on the outer surface of bow 30 and outer surface of bell 20, the these keys are indirectly monitored with the touch sensors through movements of associated parts of the key mechanism 10D. For this reason, the touch sensors 46*a* to 46*n* are integrated on and over the flexible circuit board 46, which is wound on the body 40.

The pieces of magnet 46*r* are secured to the movable portions 10Da of the key mechanism 10D, and are driven selectively to move depending upon the fingering on the key mechanism 10D. Conductive lines 46*t* are printed on a flexible insulating film 46*u*, and the conductive lines 46*t* and flexible insulating film 46*u* form in combination the flexible circuit board 46. Selected conductive lines 46*t* are assigned to the signals S1, S2 and S3, and are connected through the connector 47*b* to the downstream cable (not shown). When a user wishes to remove the downstream cable (not shown) from the hybrid musical instrument 10, he or she easily disconnect the downstream cable from the flexible circuit board 46 by virtue of the connector 47*b*.

The Hall-effect elements 46*s* are provided on the conductive lines 46*t*, and the pieces of magnet 46*r* are respectively opposed to the Hall-effect elements 46*s*. Tough not shown in FIG. 7, the conductive lines 46*t* and Hall-effect elements 46*s* are covered with another flexible film so as to be prevented from damages and disconnection.

When a player depresses the touch-pieces 43*a* to 43*h* and levers 44*a* to 44*l*, the pieces of magnet 46*r* are selectively moved toward the Hall-effect elements 46*s*. The Hall-effect elements 46*a* vary their resistance depending upon the distance from the pieces of magnet 46*r*. For this reason, when one of the pieces of magnet 46*r* is moved to the associated Hall-effect element 46*s*, the associated Hall-effect element 46*s* makes the potential level on the associated conductive line 46*t* varied. The potential level is taken out from the conductive lines 46*t* as detecting signals S4 to Sn as shown in FIG. 6.

The potential level of detecting signals S4 to Sn forms various patterns of potential level depending upon the depressed touch-pieces 43*a* to 43*h* and depressed levers 44*a* to 44*l*. In other words, the patterns of potential level are respectively corresponding to the electronic tones to be produced. The conductive lines 46*t* are connected to the controlling unit 70 so that the controlling unit 70 determines the tone intended to produce on the basis of the detecting signals S4 to Sn. The control unit 70 includes an information processor 71, a memory 72, a signal interface 73 and a MIDI interface 74 as shown in FIG. 6. The information processor 71, memory 72, signal interface 73 and MIDI interface 74 are connected to one another through a shared bus system and signal lines formed on a rigid circuit board.

The information processor 71 is an origin of information processing capability of the control unit 70, and memory 72 serves as a program memory and a working memory. A computer program and pieces of data information are stored in the memory 72. While a computer program is running on the information processor 71, the information processor 71 accepts instructions of users, and makes it possible to achieve jobs for producing the electronic tones.

The signal interface 73 includes interface units 73*a*, 73*b*, 73*c*, 73*d*, 73*e*, 73*f*, 73*g*, . . . and 73*q*, to which the sensors 62*a* to 62*c* and 46*a* to 46*n* are connected in parallel. Each of the interface units 73*b* to 73*q* includes a switching transistor and a differential amplifier. The switching transistor is connected between the signal line and one of the input nodes of differential amplifier, and a threshold voltage is applied to the other of the input nodes of differential amplifier. The detecting signal S2, S3, S4, S5, S6, S7, . . . or Sn is applied from each of the sensors 62*b* to 62*c* and 46*a* to 46*n* through the associated switching transistors to the differential amplifiers.

On the other hand, the interface 73*a* includes an amplifier, an analog-to-digital converter and a data buffer. The detecting signal S1, which represents the pressure of breath, is amplified, and discrete values on the detecting signal S1 are converted to corresponding binary numbers. The binary values are stored in the data buffer as a digital detecting signal. The digital detecting signal is representative of a piece of performance data expressing the pressure of breath.

The information processor 71 periodically changes an enable signal to the switching transistors of interfaces 73*b* to 73*q*, and makes the potential level of detecting signals S2 to Sn taken into the other of two input nodes. The potential level of detecting signals is compared with the threshold voltage so that the potential level at the output nodes of the differential amplifiers is rapidly raised to a high level corresponding to binary number "1" or rapidly decayed to a low level corresponding to binary number "0". The binary numbers are stored at the output nodes of differential amplifiers until the information processor 71 changes the enable signal to the active level, again. The binary numbers form a digital detecting signal representative of pieces of performance data. The pieces of performance data is indicative of whether or not the player depresses the touch-pieces 43*a* to 43*h* and levers 44*a* to 44*l* and how the player changes the state of tongue and mouth.

The information processor 71 periodically fetches the digital detecting signals from the interface units 73*a* to 73*q*, and the pieces of performance data are stored in the working memory.

The information processor 71 analyzes the pieces of performance data on the detecting signals S4 to Sn to see what potential level pattern the pieces of performance data express. As described hereinbefore, since the potential level patterns are respectively corresponding to the values of the pitch of electronic tones, the information processor 71 determines the pitch of tone to be produced through the analysis on the pieces of performance data on the detecting signals S4 to Sn.

The information processor 71 further analyzes the piece of performance data carried on the detecting signal S1, and determines the loudness of electronic tones. The information processor further analyzes the pieces of performance data carried on the detecting signals S2 and S3, and determines the timing to generate a tone and timing to decay the tone on the basis of the pieces of performance data. Thus, the information processor 71 determines the attributes of electronic tones to be produced and timings of tone generation.

Thereafter, the information processor 71 produces a music data code expressing the pieces of music data. In this instance, the MIDI (Musical Instrument Digital Interface) protocols are employed for the music data codes. For this reason, the music data codes are output from the MIDI interface 74

Though not shown in the drawings, an electronic tone generator and a sound system are prepared separately from the hybrid musical instrument 10. The music data codes are supplied to the electronic tone generator, and an audio signal is produced from pieces of waveform data on the basis of the music data codes. The audio signal is supplied from the electronic tone generator to the sound system so that the electronic tone is radiated from a headphone and/or loudspeakers of the sound system.

Fitting Structure of Control Unit 70

Figure 8:
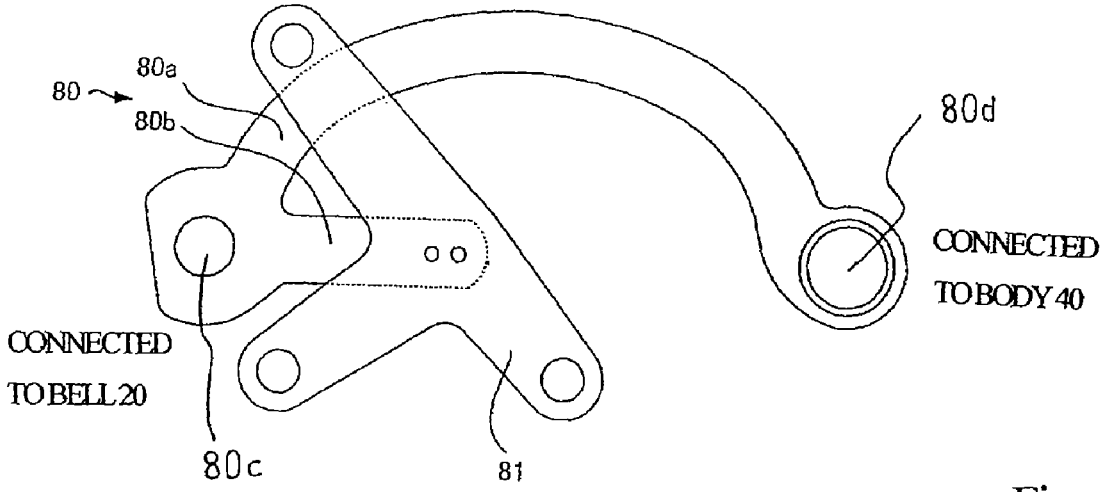
FIG. 8 is a plane view showing a bell brace and a connecting plate.

As described hereinbefore, the control unit 70 is supported by the bell brace 80. FIG. 8 shows the bell brace 80 and a coupling plate 81. The bell brace 80 is made of brace, and is thick and wide enough to support a heavy component. The enhancement of acoustic characteristics such as reverberation and long sound range is taken into account during the design work of the bell brace 80.

The bell brace 80 has a long curved portion 80*a* and a short straight portion 80*b*, and bolt holes 80*c* and 80*d* are formed in both end portions of the bell brace 80. The long curved portion 80*a* is connected at one end portion thereof to the bell 20 and at the other end portion thereof to the body 40 by means of bolts. Thus, the space between the bell 20 and the body 40 is bridged with the long curved portion 80*a*. The long curved portion 80*a* makes the bell 20 and body 40 integrated into a unitary structure, and reinforces the tubular instrument body 10C. Thus, the bell brace 80 makes the tubular instrument body 10C rigid and good in acoustic characteristics.

The short straight portion 80*b* projects from the left end portion of long curved portion 80*a*, and two holes are formed therein. The coupling plate 81 has a T-letter configuration. Two holes are formed in a central portion of coupling plate 81, and three bolt holes are formed in the projecting portions of coupling plate 81. The two holes in short straight portion 80*b* are respectively aligned with the two holes of coupling plate 81. Pins or rivets pass through the two pairs of holes, and the coupling plate 81 is fixed to the short straight portion 80*b* by means of the pins or rivets. Three bolt holes are formed in a casing of the control unit 70, and are aligned with the three bolt holes of coupling plate 81. Three bolts are respectively driven into the three pairs of bolt holes, and make the casing of control unit 70 secured to the coupling plate 81. Thus, the control unit 70 is supported by the bell brace 80 in stable through the coupling plate 81.

Since the electronic system shown in FIG. 6 is provided inside the casing of control unit 70, the control unit 70 is heavy, and large moment is exerted on the bell brace 80. If the control unit 70 is fitted to a certain surface portion of the tubular instrument body 10C, the certain surface portion does not withstand the large moment of control unit 70, and is liable to be damaged. However, the bell brace 80 is rigid enough to support the control unit 70 in stable.

Figure 3:
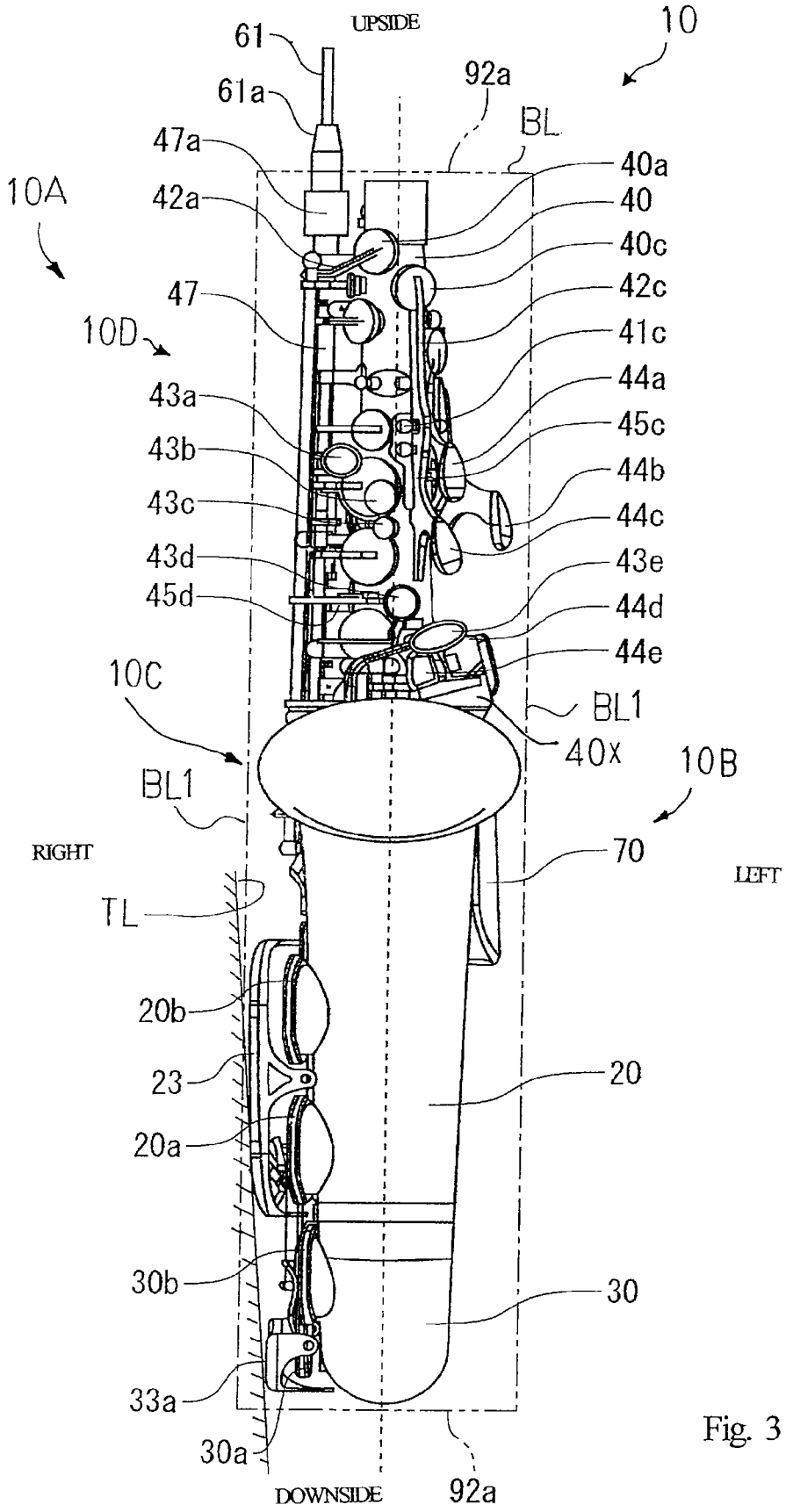
FIG. 3 is a front view showing the structure of the alto saxophone.
Figure 4:
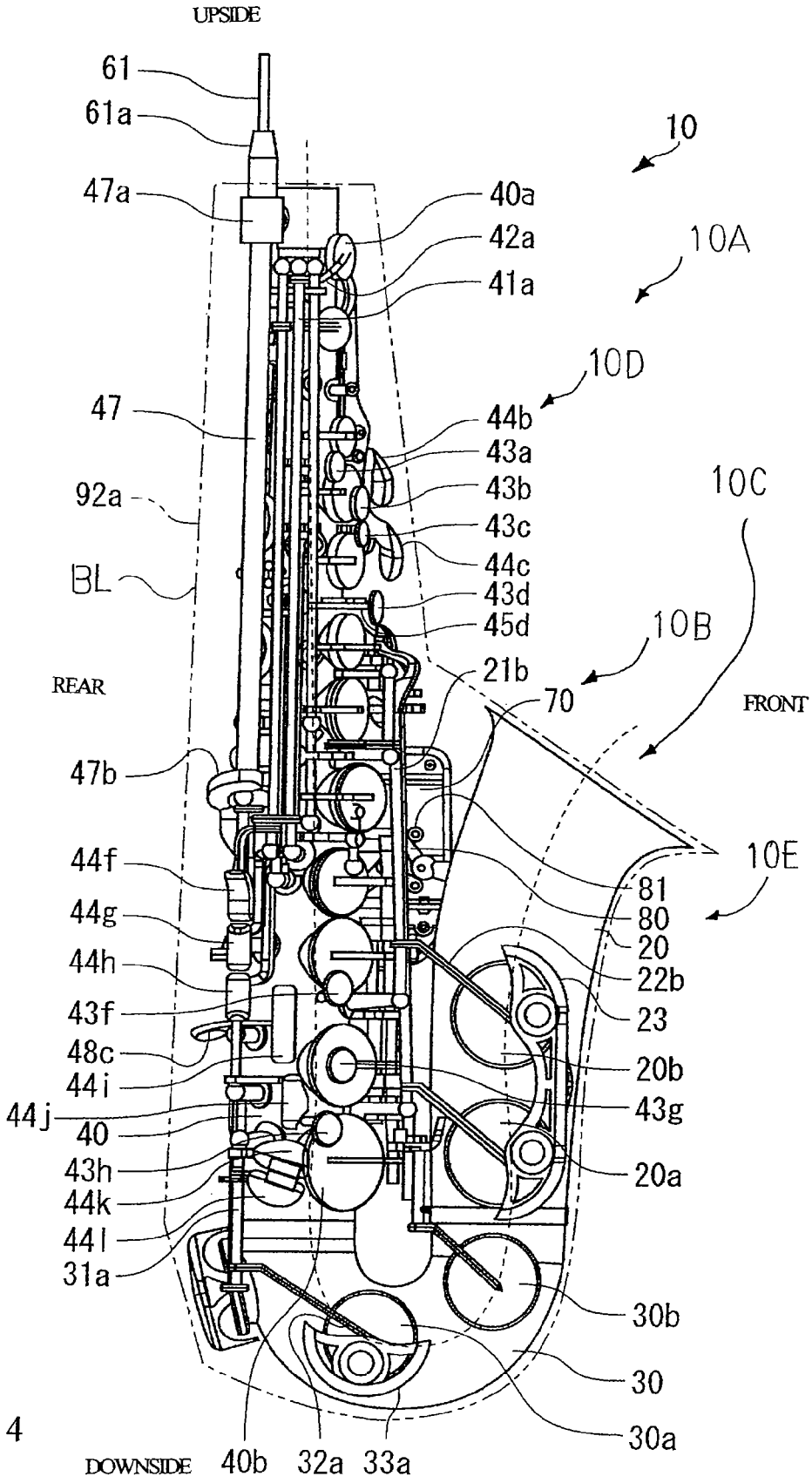
FIG. 4 is a right side view showing the structure of the alto saxophone.

Moreover, the casing of control unit 70 has an upper end 70*a* and a lower end 70*b* in the space between the table key 40*x* and the finger hook 48*c* as shown in FIGS. 1 and 3. While the player is performing a music tune on the wind musical instrument, he or she moves his or her hands in the right-and-left direction. However, the control unit 70 is out of the hand movements. Thus, the control unit 70 does not impede the movements of player's hands in the performance.

Furthermore, when the player puts the hybrid musical instrument 10 on a table, the key guards 23 and 33*a* are held into contact with the table, and keep the bell brace 80 and, accordingly, the control unit 70 over the table. In other words, the bell brace 80 keeps the control unit 70 spaced over the table, and prevents the control unit 70 from unintentional force from the table.

When the player hangs the hybrid musical instrument 10 from his or her neck through the strap, the strap is engaged with the hook 48*b*, which is not lower than the upper end 70*a* of control unit 70. The control unit 70 makes the center of gravity of hybrid musical instrument 10 lower than the hook 48*b*. For this reason, the hybrid musical instrument is stable under the condition that the player hangs the hybrid musical instrument 10 from the neck through the strap. As a result, the player can perform a music tune on the hybrid musical instrument in stable.

Case for Hybrid Musical Instrument

Figure 9:
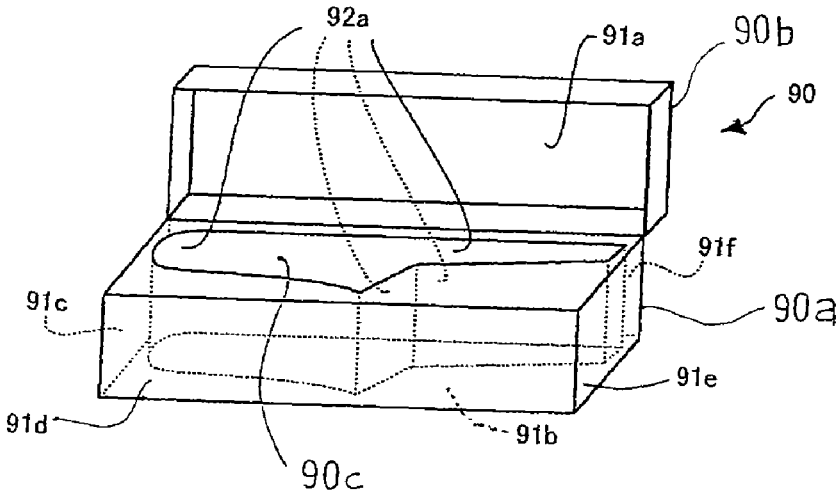
FIG. 9 is a schematic perspective view showing a case where the hybrid musical instrument is accommodated.

A case 90 is prepared for the hybrid musical instrument 10 as shown in FIG. 9. A standard alto saxophone is usually separated into the neck and the remaining tubular body, and the neck and remaining tubular body are accommodated in recesses in the case. Similarly, when a user accommodates the hybrid musical instrument 10 in the case, the neck 50 is separated from the body 40, which is still connected to the bell 20 through the bow 30, and the necks 50 and remaining tubular body 20, 30 and 40 are put in the recesses of case. It is not necessary to separate the control unit 70 from the body 40.

The case 90 has a rectangular parallelepiped configuration, and a tray 90*a* and a lid 90*b* form in combination the case 90. The lid 90*b* is hinged to the tray 90*a* so that a user opens and closes the case 90 by rotating the lid 90*b* about the hinges. When a user closes the case 90, the inner surface 91*a* of the lid 90*b* becomes parallel to the bottom surface 91*b* of the tray 90*a*. The tray 90*a* further has end surfaces 91*c* and 91*e* and side surfaces 91*d* and 91*f*. Although the tray 90*a* is formed with the recesses, one of the recesses assigned to the remaining tubular body 20, 30 and 40 is illustrated in FIG. 9, and is designated by reference 90*c*. The inner surface 92*a* defines the recess 90*c*, and the recess 90*c* has a configuration like the remaining tubular body 20, 30 and 40. For this reason, the remaining tubular body 20, 30 and 40 are received in the recess 90*c* in such a manner that the inner surface 92*a* prevents the remaining tubular body 20, 30 and 40 from clattering.

When the user puts the remaining body 20, 30 and 40 into the recess 90*c*, the remaining body 20, 30 and 40 are laid in the recess 90*c* in such a manner that a virtual plane where the centerline of bell 20, centerline of bow 30 and centerline of body 40 are laid, is in parallel to the bottom surface 91*b*. When the recess 90*c* is closed with the lid 90*b*, both of the inner and bottom surfaces 91*a* and 91*b* are in parallel to the virtual plane.

The centerlines of remaining tubular body 20, 30 and 40 are indicated by broken lines in FIGS. 1 to 4. The inner surfaces 92*a* are indicated by dots-and-dash lines BL in FIGS. 1 to 4. Dot-and-dash lines BL1 in FIG. 2 and 3 are indicative of the virtual planes, which are held in contact with the right side and left side of the remaining tubular body 20, 30 and 40 in parallel to the centerlines. As will be understood, the control unit 70 is inside the space defined by the dots-and-dash lines and dot-and-dash lines. The cable guard 47 is also inside the space defined by the dots-and-dash lines and dot-and-dash lines. Thus, the hybrid musical instrument 10 is accommodated in the case 90 without separation of the control unit 70 and cable guide 47 from the remaining tubular body 20, 30 and 40. In other words, cases for standard alto saxophones are available for the hybrid musical instrument 10.

As will be understood from the foregoing description, the control unit 70 is fitted to the bell brace 80 of tubular instrument body 10C. The bell brace 80 is so rigid that the tubular instrument body 10C can sustain the control unit in stable 70 without any damage.

The bell brace 80 keeps the control unit 70 spaced from the tubular instrument body 10C, and, for this reason, the control unit 70 allows the tubular instrument body 10C freely to vibrate. Thus, the control unit 70 does not have serious influence on the acoustic characteristics of tubular instrument body 10C.

When the hybrid musical instrument 10 is put on a flat surface TL, the key guards 23 and 33*a* keep the bell brace 80 and, accordingly, the control unit 70 over the flat surface TL. For this reason, the control unit 70, which is sustained through the bell brace 80, does not make the hybrid musical instrument 10 unstable on the flat surface.

The bell brace 80 makes the control unit 70 occupy in the space defined by the virtual planes indicated by dot-and-dash lines BL1 and a virtual plane perpendicular to the virtual planes and held on contact with the lowest portion of tubular instrument body 10C. For this reason, the hybrid musical instrument 10 is accommodated in a case designed for a standard alto saxophone.

Second Embodiment

Figure 10:
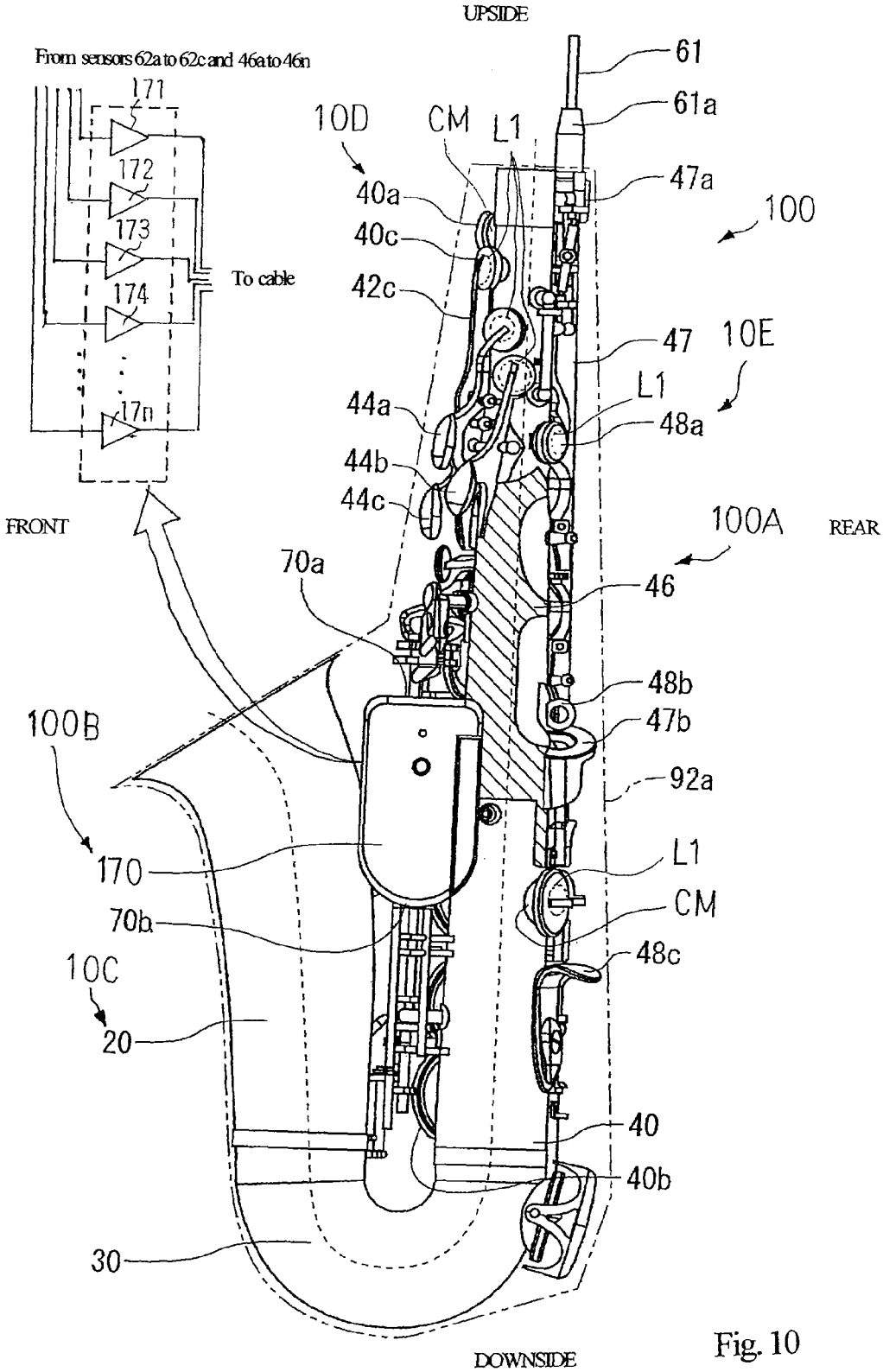
FIG. 10 is a left side view showing the structure of another hybrid musical instrument of the present invention.

Turning to FIG. 10 of the drawings, another hybrid musical instrument 100 embodying the present invention largely comprises an acoustic wind instrument 100A and an electric system 100B. The acoustic wind instrument 100A is similar in structure to the acoustic wind instrument 10A, and, for this reason, component parts are labeled with references designating the corresponding component parts of acoustic wind instrument 10A without any detailed description.

The electric system 100B is similar in system configuration to the electronic system 10B except for the circuit configuration of a control unit 170. For this reason, the other system components of electric system 100B are labeled with the references designating the corresponding system components of electronic system 10B.

The control unit 170 has plural operational amplifiers 17*l* to 17*n*, and the sensors 62*a* to 62*c* and 46*a* to 46*n* are connected in parallel to the plural operational amplifiers 17*l* to 17*n*. The signals S1 to Sn are amplified through the operational amplifiers 17*l* to 17*n*, and, thereafter, are supplied from the operational amplifiers 17*l* to 17*n* to a cable (not shown).

Though not shown in the drawings, the cable (not shown) is connected to an information processing system, which in turn is connected to an electronic tone generator. The amplified signals S1 to Sn are analyzed through the information processing system as similar to the analysis through the information processor 71, and the music data codes are produced on the basis of the signals S1 to Sn. The music data codes are supplied to the electronic tone generator, and an audio signal is produced on the basis of the music data codes. The audio signal is supplied from the electronic tone generator to a sound system (not shown), and the electronic tones are radiated from a headphone and/loudspeakers of the sound system.

Although particular embodiments of the present invention have been shown and described, it will be apparent to those skilled in the art that various changes and modifications may be made without departing from the spirit and scope of the present invention.

For example, another hybrid wind musical instrument may be a combination between the electronic system and another acoustic wind instrument, a tubular instrument body of which is reinforced with a bell brace. Of course, another sort of saxophones such as, for example, a curbed soprano saxophone, a tenor saxophone or a baritone saxophone is available for the hybrid wind instrument of the present invention.

Moreover, the bell brace is not a unique component part of saxophone. Bell braces or reinforcing braces are found in trombones and trumpets, and are appropriate to control units of electronic systems. In other words, other hybrid wind instruments of present invention may be based on the trombones and trumpets. Of course, the trombones and trumpets have component parts not found in the saxophones.

Although the bell brace 80 has the curved configuration like a bow, the curved configuration does not set any limit to the technical scope of the present invention. A bell brace may be constituted by two beams, one of which is connected at one end thereof to the body 40 and at the other end thereof to the bell 20, and the other of which projects from the one end portion of the beam without reaching the bell 20. A control unit is fitted to the other end of the other of the two beams. Another bell brace may have a closed configuration like a ring.

The combination of piece of magnet 46*r* and Hall-effect element 46*s* does not set any limit to the technical scope of the present invention. The combination of piece of magnet 46*r* and Hall-effect element 46*s* may be replaced with a photocoupler or a variable resistance sheet of conductive rubber.

The MIDI protocols do not set any limit to the technical scope of the present invention. Various sorts of music data protocols have been proposed. Any one of those sorts of music data protocols is employable for the hybrid musical instruments of the present invention.

The control unit 70 may be detachable from or fixed to the bell brace 80.

Another appropriate space may be defined in the space between the lever 44*e* for the little finger of right hand and the finger hook 48*c* as follows. The centerline of body 40, centerline of bell 20 and centerline of bow 30 define a virtual plane, and two virtual planes, which are parallel to the virtual plane, are held in contact with the thickest portion of tubular instrument body 10C. Another virtual plane, which is perpendicular to the virtual planes, is held in contact with the lowest position of tubular instrument body 10C. The aforesaid another virtual plane and two virtual planes defines the space, and the space is appropriate to the accommodation of control unit 70, because player'legs and hands do not invade the subspace in the performance.

In order to accommodate the control unit 70 in the space, a bracket may be inserted between the control unit 70 and the coupling plate 81. Moreover, a one-touch joint may be provided between the bell brace 80 and the casing of control unit 70 so as make the control unit 70 detachable.

When a user puts the remaining tubular body 20, 30 and 40 in the recess 90*c*, the control unit 70 may be located in a space over the centerlines of remaining tubular body 20, 30 and 40.

A mouthpiece may serve as both of the acoustic mouthpiece 60 and electronic mouthpiece 65. In this instance, the sensors 62*a*, 62*b* and 62*c* are detachable from the mouthpiece. When the mouthpiece serves as the acoustic mouthpiece 60, the sensors 62*a*, 62*b* and 62*c* are removed from the mouthpiece. When a player wishes to perform a music tune through the electronic tones, he or she attaches the sensors 62*a*, 62*b* and 62*c* to the mouthpiece.

An electronic tone generator may be further accommodated in the control unit. In this instance, an audio signal is output from the control unit. A compact sound system may be further accommodated in the control unit. In case where electric tones are radiated from a sound system through amplification of the vibrations of air column, a suitable pickup device is provided on or inside the bell, and amplifiers and a sound system are housed in the control unit.

One-touch joints may be used as the couplings 47*c* and 47*d*. In this instance, users easily remove the cable guard 47 from the tubular instrument body 10C.

The component parts of hybrid musical instruments 10 and 100 are correlated with claim languages as follows. The acoustic mouthpiece 60 and electronic mouthpiece 65 form in combination a "wind inlet piece", and the touch-pieces 43*a* to 43*h* and levers 44*a* to 44*l* of key mechanism 10D, thumb rest 48*a* and finger hook 48*c* form an "array of manipulators". The bell 20 and brace 80 are corresponding to a "bell" and a "bell brace". The electronic tones and electric tones are referred to "electric tones" in claims. The pitch of acoustic tones and the pitch of electronic tones are expressed as an "attribute", and the loudness and time over which the tones are continued are examples of "the other attributes". The digital signal representative of music data codes and the amplified signals serve as an "electric signal".

The lever 44*e* serves as "one of said manipulators assigned to the little finger of left hand", and the finger hook 48*c* is corresponding to "another of said manipulators where the thumb of right hand takes a rest". The key guards 23 and 33*a* serve as an "accessory part".

What is claimed is:

1. A hybrid musical instrument for selectively producing acoustic tones and electric tones, comprising:

a tubular instrument body defining a vibratory column of air therein, and having a bell through which vibrations of said vibratory column of air are propagated to the outside of said tubular instrument body as acoustic tones while a player is giving rise to said vibrations;

a wind inlet piece connected to said tubular instrument body, and blown by said player;

an array of manipulators provided on said tubular instrument body, and selectively manipulated by said player for specifying an attribute of both of said acoustic tones and electric tones;

a bell brace connected between said bell and another portion of said tubular instrument body; and an electric system including sensors monitoring movements of said manipulators and the blow into said wind inlet piece for producing pieces of performance data and a control unit sustained by said tubular instrument body through said bell brace and connected to said sensors for producing an electric signal representative of said attribute and other attributes of said electric tones.

2. The hybrid musical instrument as set forth in claim 1, in which said control unit occupies a space outside of another space where said player moves thumbs and fingers in the manipulation on said manipulators.

3. The hybrid musical instrument as set forth in claim 2, in which said manipulators are selectively assigned to thumbs and fingers of said player in standard fingering rules, wherein said space extends between one of said manipulators assigned to the little finger of left hand and another of said manipulators where the thumb of right hand takes a rest.

4. The hybrid musical instrument as set forth in claim 2, in which said tubular instrument body has a configuration like the alphabetical letter J so that said bell is opposed to said another portion of said tubular instrument body through a gap, wherein said bell brace occupies in said gap, thereby causing said space to be located on one of the both sides of said gap.

5. The hybrid musical instrument as set forth in claim 2, in which said space is nested in yet another space defined by virtual planes in contact with both sides of said tubular instrument body and parallel to another virtual plane where a centerline of said tubular instrument body extends and yet another virtual plane in contact with a lowest portion of said tubular instrument body and perpendicular to said virtual planes.

6. The hybrid musical instrument as set forth in claim 2, further comprising an accessory part protecting selected ones of said manipulators from damage and keeping said control unit over a surface on which said hybrid musical instrument is put in such a manner that said accessory part is held in contact with said surface.

7. The hybrid musical instrument as set forth in claim 1, in which said wind inlet piece includes an acoustic mouthpiece connected to said tubular instrument body and blown by said player so as to give rise to said vibrations of said vibratory column of air, and an electric mouthpiece connected to said tubular instrument body and blown by said player so as to make selected ones of said sensors produce the pieces of performance data expressing said blows.

8. The hybrid musical instrument as set forth in claim 7, in which said selected ones of said sensors are connected through a cable to said controller unit.

9. The hybrid musical instrument as set forth in claim 8, further comprising a cable guard fitted to said tubular instrument body and making said cable pass therethrough so as to prevent thumbs and fingers of said player from caught in said cable.

10. The hybrid musical instrument as set forth in claim 9, in which said cable guard has connectors in the vicinity of one of the end portions thereof so as make it possible to remove a part of said cable connected to said selected ones of said sensors from another part of said cable in said cable guard together with said electric mouthpiece.

11. The hybrid musical instrument as set forth in claim 1, in which said bell brace has an interconnecting portion connected between said bell and said another portion of said tubular instrument body and a protrusion projecting from said interconnecting portion and connected to said control unit.

12. The hybrid musical instrument as set forth in claim 1, in which said electric system further includes a flexible insulating film wound on said tubular instrument body and keeping the sensors provided for said manipulators thereon, and conductive lines formed on said flexible insulating film and propagating electric signals from said sensors for said manipulators to said control unit.

13. The hybrid musical instrument as set forth in claim 12, in which other conductive lines are further formed on said flexible insulating film so as to propagate other electric signals from a cable connected to the sensors for said wind inlet piece to said control unit.

14. An electric system for retrofitting an acoustic wind instrument including a tubular instrument body having a bell reinforced with a bell brace, a wind inlet piece and an array of manipulators to a hybrid musical instrument, comprising:

sensors monitoring movements of said manipulators and blow into said wind inlet piece for producing pieces of performance data; and a control unit sustained by said tubular instrument body through said bell brace and connected to said sensors for producing an electric signal representative of an attribute of electric tones specified through said manipulators and other attributes of said electric tones.

15. The electric system as set forth in claim 14, in which said control unit occupies a space outside of another space where said player moves thumbs and fingers in the manipulation on said manipulators.

16. The electric system as set forth in claim 15, in which said manipulators are selectively assigned to thumbs and fingers of said player in standard fingering rules, wherein said space extends between one of said manipulators assigned to the little finger of left hand and another of said manipulators where the thumb of right hand takes a rest.

17. The electric system as set forth in claim 14, in which said wind inlet piece includes an acoustic mouthpiece connected to said tubular instrument body and blown by said player so as to give rise to said vibrations of said vibratory column of air, and an electric mouthpiece connected to said tubular instrument body and blown by said player so as to make selected ones of said sensors produce the pieces of performance data expressing said blows.

18. The electric system as set forth in claim 17, further comprising a cable connected between said selected ones of said sensors and said controller unit and passing through a cable guard fitted to said tubular instrument body.

19. The electric system as set forth in claim 14, further comprising a flexible insulating film wound on said tubular instrument body and keeping the sensors provided for said manipulators thereon, and conductive lines formed on said flexible insulating film and propagating electric signals from said sensors for said manipulators to said control unit.

20. The electric system as set forth in claim 19, in which other conductive lines are further formed on said flexible insulating film so as to propagate other electric signals from a cable connected to the sensors for said wind inlet piece to said control unit.

* * * * *